US006974623B2

(12) United States Patent
Schwenk

(10) Patent No.: US 6,974,623 B2
(45) Date of Patent: Dec. 13, 2005

(54) ANTIFALSIFICATION PAPER PROVIDED WITH APPLIED CODING CONSISTING OF LUMINESCENT MOTTLED FIBERS

(75) Inventor: Gerhard Schwenk, Puchheim (DE)

(73) Assignee: Giesecke & Devrient GmbH, Munich (DE)

( * ) Notice: Subject to any disclaimer, the term of this patent is extended or adjusted under 35 U.S.C. 154(b) by 120 days.

(21) Appl. No.: 10/149,425

(22) PCT Filed: Dec. 20, 2000

(86) PCT No.: PCT/EP00/13030

§ 371 (c)(1),
(2), (4) Date: Sep. 27, 2002

(87) PCT Pub. No.: WO01/48311

PCT Pub. Date: Jul. 5, 2001

(65) Prior Publication Data

US 2003/0104176 A1 Jun. 5, 2003

(30) Foreign Application Priority Data

Dec. 23, 1999 (DE) ..... 199 62 790

(51) Int. Cl.[7] ..... D21H 21/30; B42D 15/00

(52) U.S. Cl. ..... 428/199; 428/195.1; 428/916; 162/110; 162/140; 162/141; 283/72; 283/92; 283/114

(58) Field of Search ..... 428/195, 199, 428/916; 162/110, 140, 141; 283/72, 92, 283/113

(56) References Cited

U.S. PATENT DOCUMENTS 4,181,251 A * 1/1980 Becker ..... 235/451
4,183,989 A * 1/1980 Tooth ..... 428/195.1
4,442,170 A * 4/1984 Kaule et al. ..... 428/333
4,451,521 A * 5/1984 Kaule et al. ..... 428/199
4,452,843 A * 6/1984 Kaule et al. ..... 428/199
4,463,970 A 8/1984 Kaule et al.
4,504,357 A * 3/1985 Holbein et al. ..... 162/123
4,655,788 A * 4/1987 Jalon ..... 8/648
4,921,280 A * 5/1990 Jalon ..... 283/88
4,921,534 A * 5/1990 Jalon ..... 106/31.15
5,005,873 A * 4/1991 West ..... 283/92
5,465,301 A * 11/1995 Jotcham et al. ..... 380/54
6,155,605 A * 12/2000 Bratchley et al. ..... 283/72
6,325,421 B1 * 12/2001 Huebner ..... 283/74
6,368,455 B1 * 4/2002 Missell et al. ..... 162/140
6,531,032 B2 * 3/2003 Missell et al. ..... 162/140
2002/0022112 A1 * 2/2002 Hoeppner et al. ..... 428/156
2002/0160188 A1 * 10/2002 Tam et al. ..... 428/397
2002/0179266 A1 * 12/2002 Missell et al. ..... 162/140
2003/0104176 A1 * 6/2003 Schwenk ..... 428/195
2003/0194578 A1 * 10/2003 Tam et al. ..... 428/690
2004/0239097 A1 * 12/2004 Boehm et al. ..... 283/57

FOREIGN PATENT DOCUMENTS

DE 677711 6/1939
DE 3122470 A1 1/1983
GB 2 309 710 A 5/1996

* cited by examiner

*Primary Examiner*—Jill M. Gray
(74) *Attorney, Agent, or Firm*—Bacon & Thomas, PLLC

(57) ABSTRACT

The invention relates to a security paper with at least two types of mottled fibers, which differ in terms of their luminescent characteristics and form a code. In each case one type of mottled fibers is present in a defined subarea of the security paper, and the code is represented by the defined geometric arrangement of the subareas on the security paper and/or by the presence or absence of mottled fibers of a specific type.

13 Claims, 4 Drawing Sheets

FIG. 2a
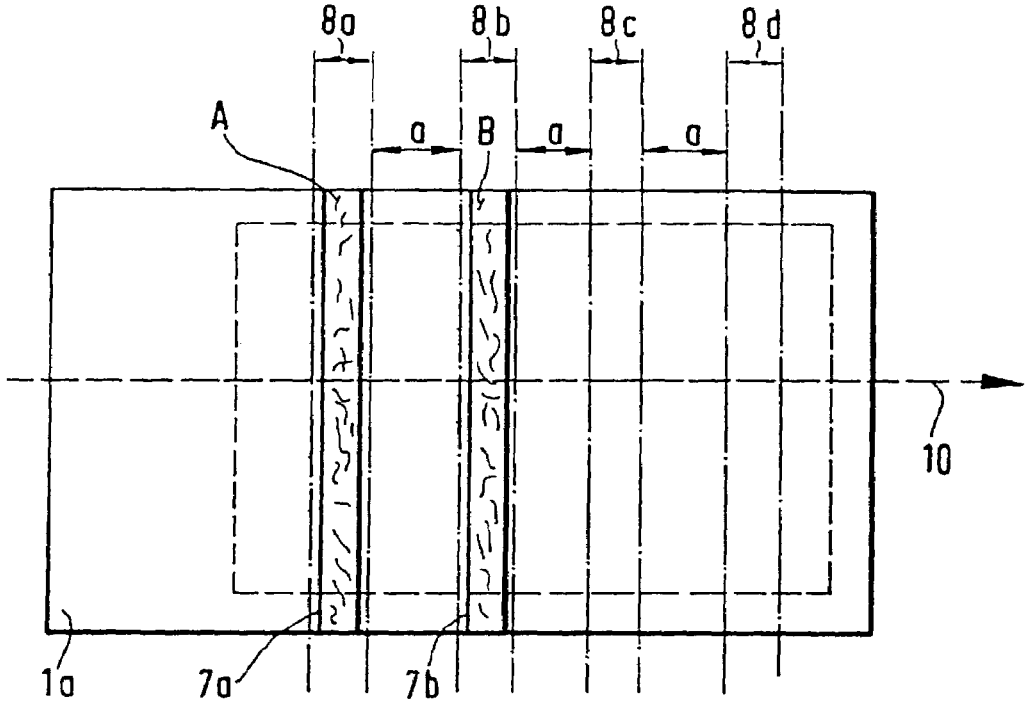
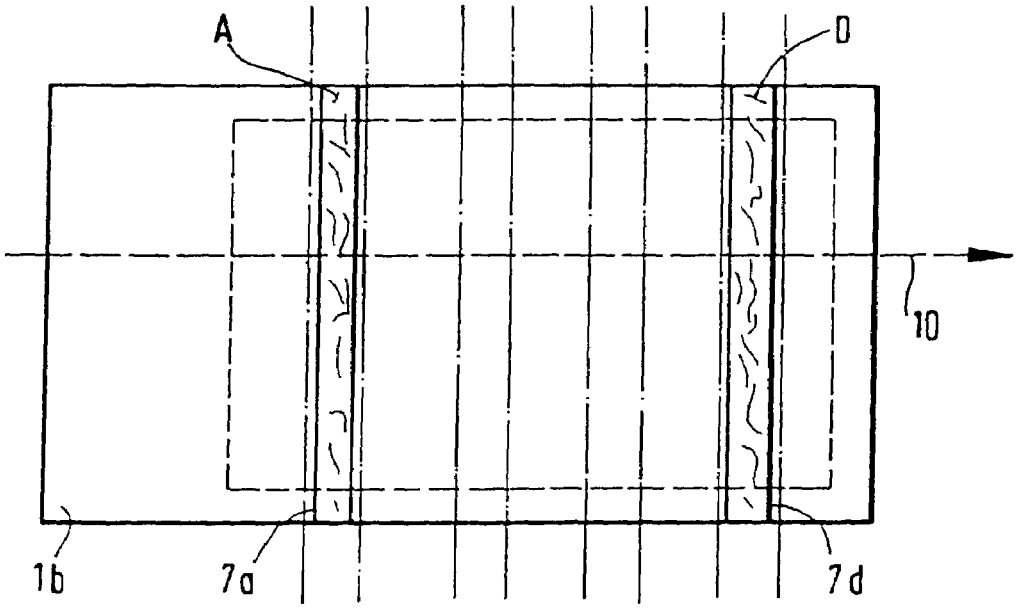
FIG. 2b

ANTIFALSIFICATION PAPER PROVIDED WITH APPLIED CODING CONSISTING OF LUMINESCENT MOTTLED FIBERS

The invention relates to a security paper having at least two types of mottled fibres, which differ in terms of their luminescent characteristics and which form a code.

The use of mottled fibres as a security feature for security documents has already been known for a long time. They usually consist of short plastic or cotton fibres, which are introduced into security papers during the paper manufacture. As compared with other security features, such as planchettes or mica flakes, mottled fibres have the advantage that mottled fibres are smaller and visually less striking and therefore exert a lower disruptive influence on the overall aesthetic impression of the security document.

DE 677 711 discloses mottled fibres which fluoresce under UV light and which are admixed with the paper stock before the sheet formation, so that the mottled fibres are subsequently present randomly distributed in the volume of the finished security paper. It is also possible for mottled fibres that fluoresce differently to be used, so that mixed fluorescence occurs under UV illumination.

In addition, DE 31 22 470-C2 discloses a security paper with luminescent mottled fibres incorporated therein. The mottled fibres here consist of cellulose acetate, which are dyed in the volume of the fibre with narrow-band-emitting luminescent substances from the group of lanthnadie-chelates. These luminescent substances can be introduced into the fibre material in a concentration up to 20 times higher than the luminescent substances known hitherto, and furthermore are distinguished by a relatively narrow-band emission spectrum. The mottled fibres can also be twisted or interwoven to form security threads. If individual fibres that luminesce differently are used for this purpose, it is therefore also possible for a code to be produced, which is based on an assessment of the presence or absence of specific luminescent substances. Under visual observation, such twisted or spun threads constitute an excellent authenticity feature. However, the intensity of the luminescence of the individual fibres, in spite of the relatively high luminescent yield of the luminescent substances proposed, is too low to be able to carry out secure authenticity testing by machine in practice.

The present invention is therefore based on the object of proposing a security paper with luminescent mottled fibres which represent a code, the intention being for the code to be very easily machine-readable.

The object is achieved by the features of the independent claims. Further developments of the invention are the subject of the subclaims.

The invention is based on the finding that for machine testing of the mottled fibres with an adequate signal/noise ratio, the mottled fibres with different luminescent characteristics have to be arranged sufficiently physically spaced apart from one another. For this reason, non-overlapping subareas are defined on the security paper according to the invention, in which in each case a specific type of mottled fibres with specific luminescent characteristics is arranged. In this case, a code can be represented by a defined geometric arrangements of the subareas and/or by the presence or absence of the mottled fibres.

As a result of the arrangement in limited subareas, the mottled fibres with the different characteristics can be localized simply, and the luminescent characteristics can be measured independently of one another without mutual influence. Since only mottled fibres with a specific luminescent characteristic are present in a subarea, the intensity of the measured signal is already increased, as compared with the known security documents, because of the higher surface density of mottled fibres in the measurement area to be tested. The signal yield can additionally be increased if specific luminescent substances with a high-intensity, narrow-band luminescent emission are used, as are described in U.S. Pat. No. 5,448,582. These luminescent substances are multiphase systems which contain an optically "pumpable" light-emitting material, light-scattering centres and a transparent matrix material. These materials exhibit laser-like effects with a spectrally extremely narrow-band emission. A further advantage of these materials is that the wavelength of the emission bands can be set in narrow ranges during manufacture.

The light-scattering centres comprise particulate, transparent materials with a preferably high optical refractive index. Under excitation by a flash of light, the luminescent substance absorbs part of the flash of light and, as a result, is transferred into an excited, "optically pumped" state. The luminescent light is produced as a result of spontaneous emission from the excited state, at least part of the emitted luminescent light not leaving the material directly but being partly scattered repeatedly at the light-scattering centres. This leads to high intensification of the emitted light intensity and also to particularly narrow emission bands.

The use of luminescent substances with narrow-band emission has the advantage that, during the measurement of the luminescent light, the spectral sensitivity range of a detector can be tuned to a narrow spectral interval, in which the emission band lies. As a result, background light from adjacent spectral ranges is suppressed during the measurement, and the signal/noise ratio is improved.

However, other preferably narrow-band emitting luminescent substances can likewise be used, since the measured signal is not determined solely by the intensity of the emitted luminescent radiation of a pigment, but also by the concentration of luminescent substance that can be introduced into the mottled fibres, and the surface density of the mottled fibres on the paper.

When choosing the surface density, however, it must be noted that the mottled fibres always become visually more striking with increasing surface density and lead to increasing disruption to the overall aesthetic impression of the security paper, often printed with an artistic illustration. The surface density of mottled fibres should therefore lie in the range of 2 to 20 mottled fibres per square centimeter. However, the disruption to the overall aesthetic impression can also be reduced by means of suitable positioning of the subareas on the security paper. This means that the subareas are preferably arranged so that the main motif of the artistic illustration is not covered.

Since the mottled fibres, as already mentioned, are to appear as little as possible under visual observation of the security document, according to a preferred embodiment, the mottled fibres comprise transparent plastic fibres, which are dyed in the volume with luminescent substances which are likewise largely transparent in the visual spectral range.

If the luminescent substances have a certain inherent colour, then with a corresponding luminescent light intensity, they can also be introduced into the mottled fibres in such low concentrations that the fibre itself still appears to be largely transparent.

Alternatively, however, the fibres can also be provided with the luminescent substance only on the surface, for example in a colouring bath.

Fibre materials used can also be other materials which may be processed to form thin fibres, such as silk or cotton.

The subareas in which the mottled fibres are arranged preferably have the form of strips which extend over the entire width of the security document. They preferably have a width in the range from 5 mm to 30 mm. However, the subareas can also have any desired other outlines, such as rectangular, round, oval, star-shaped etc.

According to the invention, the mottled fibres are introduced during the manufacture of the security paper in such a way that the mottled fibres are at least partly intermeshed with the fibre fabric of the paper and therefore are at least partly covered by paper fibres at the surface of the paper.

During the production of vat-made paper, the Wilcox process, as it is known, for example constitutes a suitable process for the introduction of mottled fibres in endless, strip-like subareas. In this case, the mottled fibres are suspended in an aqueous suspension and, during the paper manufacture, are applied to the rotating cylinder wire by means of a pipe, whose end has a special exit nozzle, close to the point at which the sheet formation just begins on the cylinder wire. By means of a vacuum produced within the cylinder wire, the layer of mottled fibres applied in this way is dewatered immediately, as a result of which the mottled fibres, together with the first layer of paper fibres depositing on the cylinder wire, are laid firmly onto the cylinder wire.

In the case of the manufacture of fourdrinier papers, the fibres can be applied in a similar way to the fourdrinier wire.

Depending on the type of code, a plurality of application stations for mottled fibres with different luminescent characteristics are arranged parallel to one another in the paper machine. In this case, the feed devices of the mottled fibres are controlled in accordance with the code to be applied. If the code consists solely in the geometric arrangement of the subareas provided with different mottled fibres, then the feed devices are positioned appropriately on the paper machine at the start of paper production. The mottled fibre feed is then carried out continuously.

If the code consists exclusively or additionally in the presence or absence of one or more types of mottled fibres, then the feed of these mottled fibres has to be stopped in accordance with the code. If the code does not change within the manufacture of a paper web, it is also sufficient here to place the necessary feed devices appropriately at the start of production.

In this case, the code can represent any desired information, for example the denomination, issue date, country of issue or the like.

The finished security paper which, in addition to the code according to the invention can of course have further security elements, such as a security thread or the like, is subsequently further processed in the conventional way, in particular printed and cut up into individual security documents, such as banknotes, share certificates, cheques or the like.

During the machine-checking of the security documents, the code is measured with appropriate sensors for the respective luminescent characteristic of the mottled fibres to be evaluated and is compared with a reference value. The luminescent characteristic to be evaluated may be, for example, the luminescent wavelength or the decay time of the luminescent radiation.

Exemplary embodiments and further advantages of the invention will be explained below using the figures. Reference is made to the fact that the figures do not offer any true-to-scale representation of the invention but are used merely for illustration.

In the figures:

FIG. 1 shows a view of a security document, here a banknote, having three strip-like subareas into which mottled fibres are introduced;

FIGS. 2*a, b* show a view of two security documents each having four strip-like subareas which represent a different code;

Shown dashed on the security document 1 is the edge 3 of an image field, in which an artistic illustrative representation 4 (not shown in the figure) is often printed. On the security document 1, three strip-like control areas 8*a*, 8*b*, 8*c* are indicated by dash-dotted lines. They designate the areas in which the detector checks the characteristics of the luminescent mottled fibres. Their position on the security document 1 is therefore determined by the code to be tested.

The distance between the control areas 8*a* and 8*b* is designated by a, and the distance between the control areas 8*b*, 8*c* is designated by b, the distances a, b in the embodiment shown being different. The ratio between the distances a, b can be selected to be integer, for example. Located within the three strip-like control areas 8*a*, 8*b*, 8*c* are strip-like subareas 5*a*, 5*b*, 5*c*, in which mottled fibres are introduced into the security paper 2. The boundary lines of the strip-like subareas 5*a*, 5*b*, 5*c* are illustrated by continuous lines in FIG. 1. However, the continuous lines serve merely for illustration and are not present on an actual security document.

Figure 1:
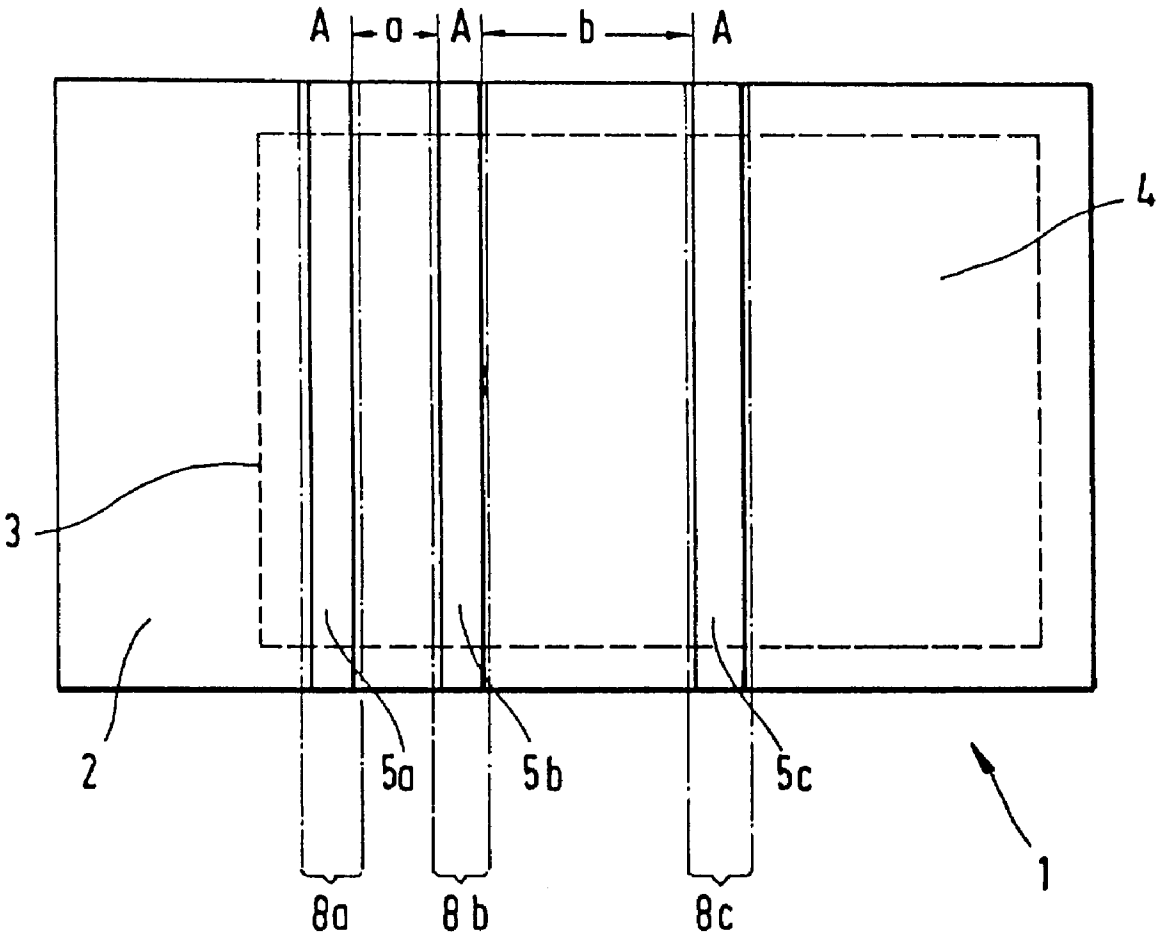
FIG. 1 shows a view of a security document 1, here a banknote, which is manufactured from security paper 2.

In the embodiment shown in FIG. 1, all the strip-like subareas 5*a*, 5*b*, 5*c* are provided with mottled fibres of the same type A, that is to say in all the subareas 5*a*, 5*b*, 5*c* there are mottled fibres with the same luminescent characteristic. In this embodiment, the code is represented solely by the distances a, b between the subareas 5*a*, 5*b*, 5*c* and the control areas 8*a*, 8*b*, 8*c*.

FIG. 2 shows another possibility for a code according to the invention, using the example of two security documents 1*a*, 1*b*. In this case, the distance a between the individual control areas 8*a*, 8*b*, 8*c*, 8*d* is constant and the code is represented by the presence or absence of one or more subareas with specific mottled fibres within the control areas 8*a*, 8*b*, 8*c*, 8*d*. In this case, the mottled fibres arranged in the subareas differ in the luminescent characteristic to be tested. For example, the document 1*a* has subareas 7*a*, 7*b*, in which there are mottled fibres of the type A and B, respectively, only within the control areas 8*a*, 8*b*, whereas the document 1*b* is provided with subareas 7*a*, 7*b* having mottled fibres A, D only in the control areas 8*a*, 8*d*.

Accordingly, the code system comprises four types of luminescent mottled fibres, A, B, C, D, which differ with respect to one or more of their luminescent characteristics and whose presence or absence in predefined control areas is checked. If the presence of the correct luminescent characteristic in the predefined control area is assigned the logic state "1", and the absence of the corresponding substance is assigned the state "0", then with the aid of the code system described, $2^4-1=15$ practical binary codes may be represented.

In the case of checking the document 1*a* within the measurement track 10 running along the document, an appropriate detector would determine the binary code 1100 in this case. For the document 1*b*, the binary code that results is 1001.

Of course, the number of control areas used and the number of different mottled fibres can be varied as desired. For example, the same mottled fibres with the same luminescent substance can also be used for all the control areas. This has the advantage that the structure of the sensor can be significantly more simply configured.

On the other hand, if the code is to be configured in a still more complicated way, then the distances between the control areas can additionally be varied, analogously to the embodiment shown in FIG. 1.

During the checking of the document, any desired characteristics of the luminescent substances contained in the mottled fibres can be evaluated, such as the luminescent wavelength or the decay time of the luminescent radiation.

Figure 3:
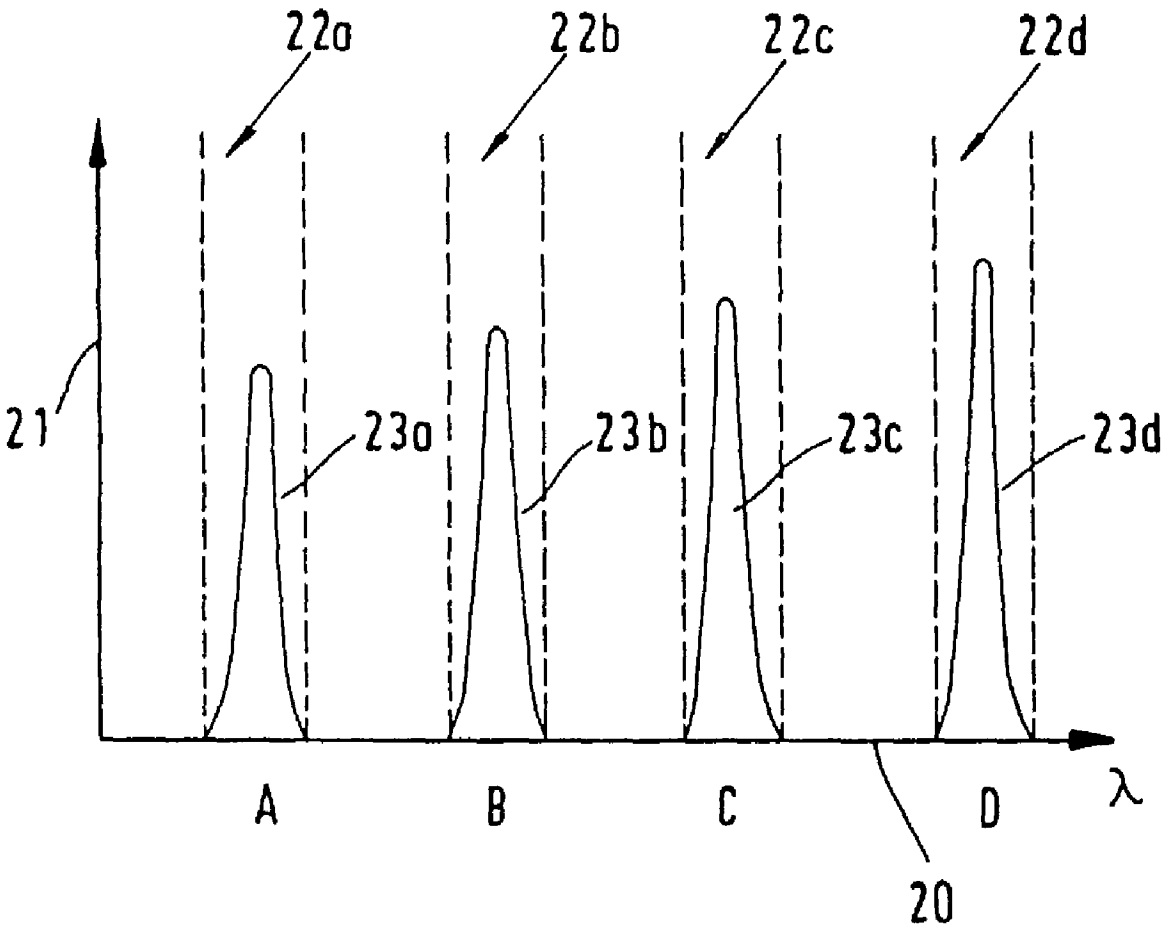
FIG. 3 shows a detail of the wavelength spectrum with four defined wavelength intervals for a code system comprising four different luminescent substances.

FIG. 3 shows, for the case of wavelength-dependent evaluation, a possible spectral distribution of the emission wavelengths of the abovedescribed code system comprising four types A, B, C, D of mottled fibres which, in the simplest case shown here, differ at least with respect to their emission wavelengths. Accordingly, the luminescent substance A emits at shorter wavelengths than the luminescent substances B, C, D. As can be seen from FIG. 3, all the substances A, B, C, D each exhibit a very narrow-band luminescent emission, which does not overlap that of the other luminescent substances used, so that the luminescent substances A, B, C, D can be distinguished very well from one another. The luminescent intensity of the substances is likewise sufficiently high, so that the substances can be detected and verified reliably by machine.

Figure 4:
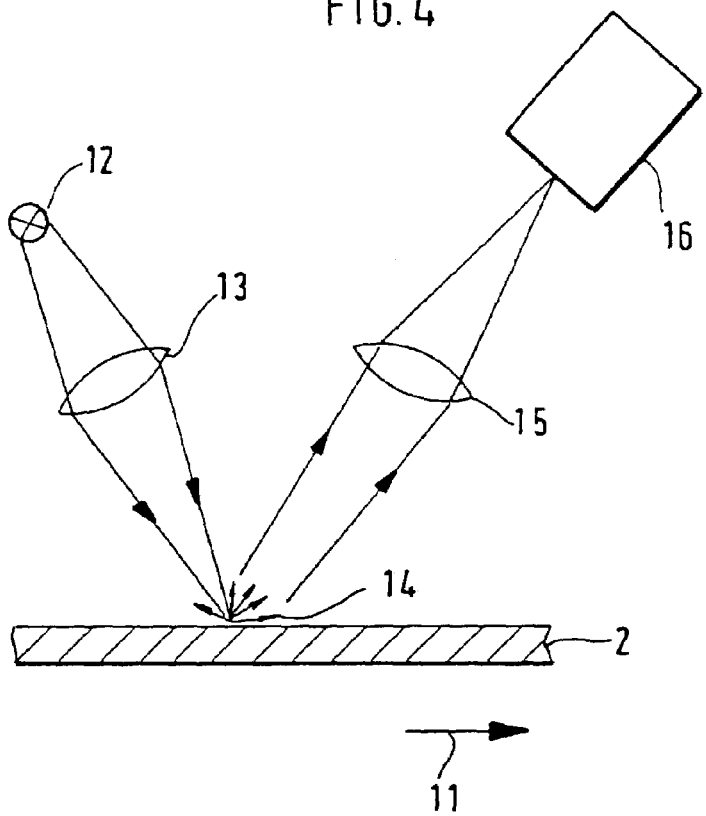
FIG. 4 shows an arrangement for measuring the luminescent characteristics of mottled fibres which are introduced into a security document in various subareas.

FIG. 4 shows in schematic form a possible arrangement for the detection and evaluation of a code, which is represented with the aid of the luminescent substances or mottled fibres shown in FIG. 3 and having emission lines.

The check of the banknote normally takes place in a banknote processing device, through which the banknotes are guided past the sensors at high speeds with the aid of a transport system. In FIG. 4, this transport of the banknote 2 according to the invention is indicated by the arrow 11. In this case, the banknote runs past an illumination source 12, whose radiation is focused onto the document with the aid of an optical system 13. The illumination source 12 is chosen so that it emits radiation of the excitation wavelength of the individual luminescent substances. If the excitation wavelengths of the individual luminescent substances lie in different wavelength ranges, it may be expedient to use as the illumination source a plurality of excitation sources, each of which emits light in the range of one of the excitation wavelengths. If a region of the document 2 according to the invention is illuminated in which there are luminescent mottled fibres according to the invention, then these fibres are excited into luminescence. The frequently diffuse luminescent radiation 14 is finally focused onto a detector 16 via a further optical system 15. This detector 16 preferably contains a spectrometer with a diode array, each of the diodes being sensitive to one of the emission wavelengths 23*a* to 23*d*.

Figure 5:
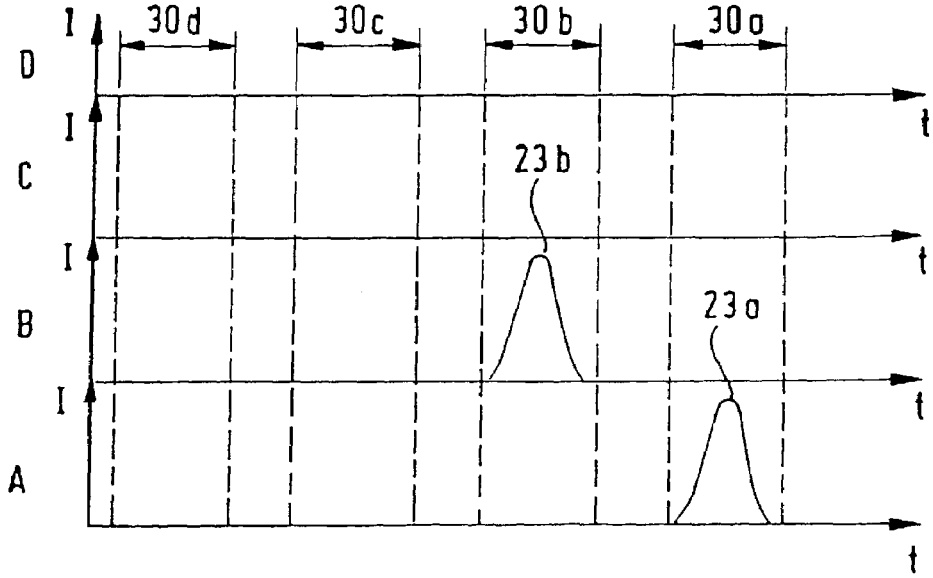
FIG. 5 shows the time variation of the electrical signals at the output of the light detector from the arrangement of FIG. 4 during the checking of the document according to FIG. 2*a*.

If, for example, the banknote 1*a* according to FIG. 2*a* is transported past under the measuring device shown in FIG. 4 and if the mottled fibres A, B exhibit the emission lines 23*a*, 23*b* illustrated in FIG. 3, then the detector picks up the signals shown in FIG. 5 in the measurement channels associated with the control areas 8*a*, 8*b*, 8*c*, 8*d*.

In FIG. 5, the signals I from the measurement channels associated with the individual mottled fibre types A, B, C, D are plotted against the time t. The time windows 30*a*, 30*b*, 30*c*, 30*d* shown dashed correspond to the control areas 8*a*, 8*b*, 8*c*, 8*d* and designate the measurement windows in which in each case a signal is expected. If the note 1*a* is led past under the sensor in the direction of the arrow 11, then the control area 8*d* is illuminated first. Since there are no mottled fibres within this control area, the associated measurement channel does not perceive any signal in the time window 30*d*. Since the mottled fibres of type C are not present either, the associated measurement channel likewise does not receive any signal. Only when the subarea 7*b* or the control area 8*b* is transported past under the sensor arrangement does the sensor record the emission band 23*b* of the luminescent substance B in the time window 30*b*. This is analogously true for the following subarea 7*a* and the signal 23*a* in the time window 30*a*. If, as already explained, the presence of the luminescent emission 23*a*, 23*b*, 23*c*, 23*d* in the correct time window 30*a*, 30*b*, 30*c*, 30*d* signifies a binary "1" and the lack signifies a binary "0", then the code 1100 is represented by the signals in FIG. 5.

What is claimed is:

1. Security paper comprising at least two types of mottled fibres with mutually different luminescent characteristics;

wherein the security paper has at least two non-overlapping subareas in which there is only one specific type of mottled fibres, respectively, the type of mottled fibers being specific for the respective subarea;

wherein an information is equally coded by a geometric arrangement of the subareas and the presence of the types of mottled fibres.

2. Security paper according to claim 1, wherein the mottled fibres contain luminescent substances with characteristic luminescent characteristics.

3. Security paper according to claim 2, wherein the luminescent substances have a spectrally narrow emission band.

4. Security paper according to claim 2, wherein the luminescent substances emit outside the visual spectral range.

5. Security paper according to claim 2, wherein the luminescent substances comprise optical intensifying materials which comprise an optically pumpable, light-emitting material, light-scattering centers and a transparent matrix material.

6. Security paper according to claim 2, wherein the luminescent substances are present in the volume of the mottled fibres.

7. Security paper according to claim 2, wherein the mottled fibres are dyed with the luminescent substances.

8. Security paper according to claim 1, wherein the mottled fibres comprise a plastic material.

9. Security paper according to claim 1, wherein the mottled fibres have been introduced into the security paper during the paper manufacture.

10. Security paper according to claim 1, wherein the mottled fibres have been introduced into the security paper by means of the Wilcox process.

11. Security paper according to claim 1, wherein the geometric arranged subareas are in the form of strips.

12. Security paper according to claim 11, wherein the width of each strip lies in the range from 5 mm to 30 mm.

13. Security paper according to claim 1, wherein the mottled fibre density in the subareas lies in the range of 2 to 20 mottled fibres per square centimeter.

* * * * *